United States Patent [19]

Wada et al.

[11] 4,304,495

[45] Dec. 8, 1981

[54] PRINT HAMMER IN DOT PRINTER

[75] Inventors: Shiyoji Wada, Hiratsuka; Yoshihiko Sano, Hatano, both of Japan

[73] Assignee: Pilot Man-Nen-Hitsu Kabushiki Kaisha, Tokyo, Japan

[21] Appl. No.: 44,742

[22] Filed: Jun. 1, 1979

[30] Foreign Application Priority Data

| | | | |
|---|---|---|---|
| Jun. 2, 1978 | [JP] | Japan | 53/66575 |
| Jun. 2, 1978 | [JP] | Japan | 53/75457[U] |
| Jun. 2, 1978 | [JP] | Japan | 53/75458[U] |
| Jun. 2, 1978 | [JP] | Japan | 53/75459[U] |
| Jul. 6, 1978 | [JP] | Japan | 53/82437 |
| Jul. 6, 1978 | [JP] | Japan | 53/92961[U] |
| Apr. 27, 1979 | [JP] | Japan | 54/51361 |

[51] Int. Cl.[3] ..... B41J 3/10

[52] U.S. Cl. ..... 400/124; 101/93.48

[58] Field of Search ..... 400/121, 124, 144.2; 101/93, 48

[56] References Cited

U.S. PATENT DOCUMENTS

| | | | |
|---|---|---|---|
| 3,905,294 | 9/1975 | Barrus et al. | 101/93.48 |
| 3,924,528 | 12/1975 | Ludin | 101/93.48 |
| 3,941,051 | 3/1976 | Barrus et al. | 400/121 |
| 4,044,668 | 8/1977 | Barrus et al. | 101/93.48 |
| 4,121,517 | 10/1978 | Dobson | 400/463 |
| 4,155,660 | 5/1979 | Takahashi et al. | 400/124 |

FOREIGN PATENT DOCUMENTS

| | | | |
|---|---|---|---|
| 2240939 | 2/1974 | Fed. Rep. of Germany | 101/93.48 |
| 2419442 | 11/1975 | Fed. Rep. of Germany | 400/124 |
| 2525528 | 12/1976 | Fed. Rep. of Germany | 400/121 |
| 2716067 | 11/1977 | Fed. Rep. of Germany | 400/144.3 |

OTHER PUBLICATIONS

Skinner, "No Work Print Hammer", IBM Technical Disclosure Bulletin, vol. 21, No. 11, pp. 4452–4453, 4/79.

*Primary Examiner*—William Pieprz

*Attorney, Agent, or Firm*—Sughrue, Mion, Zinn, Macpeak & Seas

[57] ABSTRACT

A print hammer in a dot printer is formed with a contactor secured to the free end portion of a leaf spring or to a contactor base provided on the free end portion of the leaf spring. The contactor is made of a wear-resistive alloy selected from the group consisting of platinum group metal alloys, alloys of platinum group metal and transition metal, and alloys of platinum group metal, transition metal and boron.

12 Claims, 36 Drawing Figures

PRINT HAMMER IN DOT PRINTER

BACKGROUND OF THE INVENTION

This invention relates to a print hammer having wear-resistive contactor in a dot printer.

A dot printer operates to print characters on a recording sheet with small points, namely, dots which are formed on the recording sheet by several dotting members arranged adjacent to one another. The dotting members are actuated to hammer the recording sheet through a carbon ribbon with suitable timing to form dots on the recording sheet. If the dot printer is employed, it is unnecessary to provide a number of pieces of type in advance, and it is possible to print characters using only a few dotting members. Thus, a dot printer has been extensively employed in a variety of printing systems.

In one prior art dot printing system, print hammers adjacent to one another in a line are arranged in parallel either with the dotting surface of a recording sheet moving vertically or a copying material moving horizontally. Among these print hammers, only the print hammers necessary for printing a contemplated character are operated to print dots thereby forming the character. This operation is repeatedly carried out to print a line of characters.

The selection of print hammers and the timing of operating the print hammers for printing a particular character are stored in a separate memory device, so that dots can be printed according to instructions in a very short time. Thus, printing can be achieved at a high rate of about 200 dots/second.

In general, the above-described print hammer has a dotting contactor which is secured to a leaf spring. The leaf spring serves as the armature of an electromagnet provided behind it. Since the contactor should satisfactorily strike an ink ribbon or a recording sheet to print a dot, the contactor has a small contact end (for instance, 0.2 to 0.8 mm) in diameter and its height is of the order of 2 to 5 mm. The electromagnet pulls the leaf spring to a position where the leaf spring is relatively bent from its rest position, with its support a fulcrum. The electromagnet releases the leaf spring in response to an instruction signal from the above-described memory device to thereby print a dot by the utilization of the elastic force of the leaf spring.

Such a conventional protruding contactor is extremely disadvantageous in that, since it is made of steel, it is significantly worn, i.e., the length of the contactor is reduced. As a result the hammer swinging distance is increased, or the contact surface of the contactor is rounded, i.e., the edge of the contact surface is removed. As a result the printed dot is not sharp and the character formed is not clear.

In order to overcome the difficulty where the contactor is easily worn out, the contactor has been made of sintered hard alloys such as tungsten carbide-cobalt alloys. However, a contactor made using these materials is poor in rigidity; that is, it is liable to be cracked or broken. Furthermore, the contactor is low in corrosion resistance when encountering ink or the like. Accordingly, steel that is unsatisfactory in wear-resistance and corrosion resistance is still used to manufacture the contactor, although the problems remain largely unsolved.

The inventor has conducted intensive research to overcome the above-described difficulties. As a result of the research, the inventor has found that if the contactor is made of a particular alloy, then, the wear-resistance is improved, the contactor will not be broken, the service life is increased, troublesome print hammer replacement can be eliminated, and the reliability of the dot printer can be improved, and accomplished.

SUMMARY OF THE INVENTION

This invention resides in the provision of a print hammer in a dot print, which comprises a contactor secured to the free end portion of a leaf spring or to a contactor base provided on the free end portion of the leaf spring. The contactor is made of a wear-resistive alloy selected from the group consisting of platinum group metal alloys, alloys of platinum group metal and transition metal, and alloys of platinum group metal, transition metal and boron.

The alloys forming the contactor according to the invention are uniform in composition, and suitable in hardness (of the order of 600 to 10,000 in Vickers hardness). With the alloys, the configuration of the contactor can be changed as desired by melting or sintering. The contactor can be ground and machined. Unlike the conventional contactor made of sintered hard metal, the contactor according to the invention will not be broken in ordinary service use, is adjustable in rigidity, and is high in corrosion resistance. The alloys according to the invention are very high in wear-resistance when compared with steel as well as other conventional materials. Thus, the above-described alloys are considerably useful for the contactor.

The platinum group metal includes six metals: ruthenium (Ru), rhodium (Rh), palladium (Pd), osmium (Os), iridium (Ir) and platinum (Pt). In this invention, the alloys are prepared by combining two or more among these metals. These alloys are excellent in wear resistance, and can be readily formed into a small block such as a small ball having a fine surface, which is provided on a leaf spring.

Each of the alloys is made from osmium 10 to 90% by weight and the remaining platinum group metals, preferably osmium 50% by weight and iridium 50% by weight.

The alloys of these platinum group metals are most preferable in the invention. However, since these metals are expensive, part of the metal may be replaced by transition metals without lowering the property of the alloy and accordingly the contactor. In this case, the contactor can be made economically. The alloy containing the transition metal can be readily machined and is high in welding strength.

Many transition metals are available; however, in the invention, the following fourteen metals are employed: titanium (Ti), vanadium (V), chromium (Cr), mangnese (Mn), iron (Fe), cobalt (Co), nickel (Ni), zinc (Zn), niobium (Nb), molybdenum (Mo), hafnium (Hf), tantlum (Ta), tungsten (W) and rhenium (Re).

Thus, preferably the above-described alloys are made from one or more platinum group metals 10 to 90% by weight (especially 20 to 50% by weight) and the remaining one or more transition metals.

If boron is added to the alloy of platinum group metal and transition metal, then the contactor made of the alloy exhibits excellent wear-resistance.

Such alloys are preferably made from one or more platinum group metals 10 to 90% by weight (especially 20 to 50% by weight), boron 0.2 to 2.0% by weight, and the remaining one or more transition metals.

In the invention, the contactor made of the wear-resistive alloy is provided on the free end portion of a leaf spring.

The free end portion of the leaf spring may be flat as it is, or may be bent L-shaped, or may be formed arcuate. The contactor may be secured to the end of the free end portion or to one surface of the same. In the case where the contactor is secured to the end of the free end portion of the spring, it is necessary to protrude the contactor at least from the plane of the leaf spring.

The contactor may be in the form of a column, a cone, a trapezoid, a sphere or combinations of them. It is suitable that the contact end of the contactor is formed like a column or a sphere. In order to simultaneously print record on a plurality of sheets such as vouchers laid one on another, it is preferable that the contact end of the contactor is in the form of a column.

It is suitable that the contactor be fixedly secured to the leaf spring by brazing or welding. If, in this connection, the area of the jointing part of the contactor is made larger than the area of the contact end of the contactor, then the contactor can be more strongly secured to the leaf spring.

The contactor may be secured to the leaf spring with the flat surface of these two parts in contact with each other. However, it is more suitable if the contactor is secured to the leaf spring with the curved surface of the two parts in contact with each other. When the contactor is caught by the moving ink ribbon, then a lateral force forming an angle with the axis of the contactor is applied to the contactor. However, if the contactor is secured to the leaf spring through the curved surfaces, the curved surfaces receive the lateral force perpendicularly or with a deep angle. Hence, the contactor is not significantly shifted, and accordingly it can completely prevent the contactor from coming off the leaf spring. Thus, it is desirable that when the contactor is secured to the leaf spring by welding, the curved surface of the contactor is brought into contact with the curved surface of the leaf spring. The wear-resistive alloys forming the contactor of the invention have high melting points, and accordingly, only a small molten layer is formed between the contactor and the leaf spring. Therefore, if the contactor is welded to the leaf spring through their flat surfaces, the contactor may be dropped off the leaf spring when the contactor is repeatedly caught by the ink ribbon. Thus, it is suitable for the contactor to be in contact with the leaf spring through their curved surfaces by welding. The curved surface of the contactor may be concave or convex with respect to the leaf spring.

One leaf spring may be provided for one print hammer. However, it is apparent that a plurality of print hammers can be provided by using a comb-shaped leaf spring whose teeth serve as the separate leaf springs for the print hammers. The material of the leaf spring may be steel generally used as elastic material or a compound material comprising steel and elastic non-ferrous metal.

A print hammer using a contactor base according to the invention will be described in conjunction with this technology. The contactor is connected to the contactor base.

The reason why the contactor base is employed for securing the contactor is to make the contactor smaller to reduce the weight of the end portion of the print hammer and to regularly swing the hammer to maintain the hammer driving timing unchanged. Furthermore, the provision of the contactor base is advantageous in the following points. Since the height of the contactor can be reduced as much as the height of the contactor base, the joined contactor's strength can be maintained satisfactorily without lowering the performance of the print hammer. The contactor is set closer to the copying material or recording sheet as much as the height of the contactor base protrudes from the plane of the leaf spring. Therefore, the contactor swinging distance is similarly, reduced, with the result that the print hammer can be operated at a higher speed.

The contactor base used in the invention is formed by the following method (A), (B), (C) or (D):

(A) The free end portion of the leaf spring is bent L-shaped or arcuate so that the end protrudes from the plane of the original leaf spring.

(B) The free end portion of the leaf spring in bent, so that the bent portion protrudes from the plane of the original leaf spring.

(D) A protrusion is joined to one surface of the free end portion of the leaf spring or to the end of the free end portion.

(C) A part of the free end portion of the leaf spring is subjected to padding, to protrude from the plane of the leaf spring.

It is suitable that the contactor base formed by the method (A), (B) or (C) is joined to the contactor by brazing or welding. In this case, the contactor can be provided without forming a hole in the leaf spring. Hence, nothing to interrupt the magnetic path is present on the rear surface of the leaf spring with the result that the electromagnet can be effectively operated.

If the contactor base formed according to method (B) is employed, then the contactor can be set at a position farther from the swing fulcrum, with the advantageous result that the dotting pressure is increased to improve the quality of print. Furthermore, even if the contactor is joined to the contactor base by the application of heat, the leaf spring is not affected by the heat, i.e., it is not strained, because the joint is effected at the end portion of the leaf spring.

In the case of a print hammer using the contactor base formed according to the method (D), metal which can be readily connected to both the leaf spring and the contactor can be freely selected, and accordingly, the joining conditions are not limited. The contactor base may be joined to the surface of the free end portion of the leaf spring by brazing or welding. However, it is preferable that the contactor base is mechanically connected to the leaf spring by using rivets, or bolts and nuts, or by stacking, because in these techniques no heat is generated. The contactor can be fixedly secured to the contactor base by staking or the like; however, it is preferable in view of joint strength that the contactor is welded to or brazed to the contactor base. The contactor base may be in the form of a bar or a plate, or it may be tapered towards the end. Various materials such as stainless steel, other metals and alloys can be widely emloyed as the material for the contactor base.

In order to eliminate the concentration of stress to the contactor base to prevent it from being bent or broken, it is effective to taper the contactor base so that the contactor base and the contactor form a smooth surface.

Also, in the case where such a contactor base is employed for the print hammer, it is effective to prevent the contactor from coming off the contactor base that the contactor be joined to the contactor base with the curved surfaces of the two components in contact with each other.

The contact end of the contactor may be in the form of a bar or a ball. Alternatively, it may be inclined towards the end of the free end portion of the leaf spring.

The inclined contact end is convenient in the case where it is impossible to set the print hammer in parallel with the copying material or the recording sheet. The bar-shaped contact end is suitable for general printing operations. The ball-shaped contact end is convenient in the case where the contactor is made smaller in size or the platen is elastic.

The nature, principle and utility of the invention will become more apparent from the following detailed description and the appended claims when read in conjunction with the accompanying drawings, in which like parts are designated by like numerals.

DETAILED DESCRIPTION OF THE INVENTION

Figure 1:
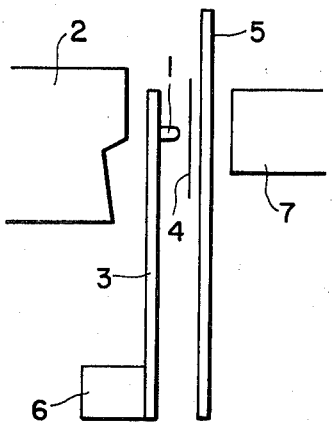
FIG. 1 is an explanatory diagram showing the dotting drive section of a dot printer.

FIG. 1 shows a dotting drive section in a conventional dot printer with print hammers. The section comprises a contactor 1, an electromagnet 2, a leaf spring 3, an ink ribbon 4, a recording sheet 5, a support 6, and a platen 7.

FIGS. 2 through 36 show various examples of a print hammer according to this invention.

Figure 2:
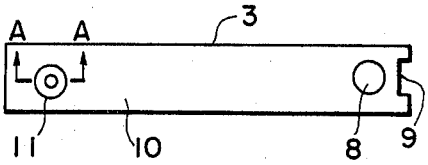
FIG. 2 is a plan view of one example of a print hammer according to this invention.
Figure 3:
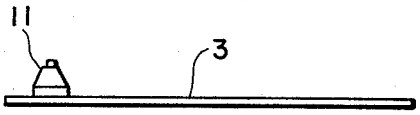
FIG. 3 is a front view of the print hammer shown in FIG. 2.
Figure 4:
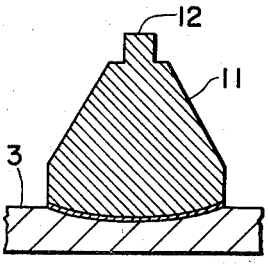
FIG. 4 is an enlarged sectional view taken along line A—A in FIG. 2.

In FIGS. 2 through 4, each print hammer comprises a contactor 11 which is made of a wear-resistive alloy selected from the group consisting of platinum group metal alloys, alloys of platinum group metal and transition metal, and alloys of platinum group metal, transition metal and boron. The contactor 11 is brazed to or welded to one surface of one free end portion of a leaf spring 3. The contactor 11 is substantially in the form of a taper, and has a column-shaped contact end 12. The print hammer further comprises a through-hole for mounting the print hammer on a support 6, and a notch 9.

Figure 5:
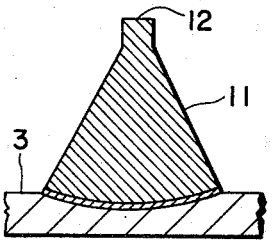
FIGS. 5 through 36 are enlarged sectional view showing the essential components of other examples of the print hammer according to the invention.

A print hammer shown in FIG. 5 is different from that shown in FIG. 4 only in that the contactor 11 is conical.

Figure 6:
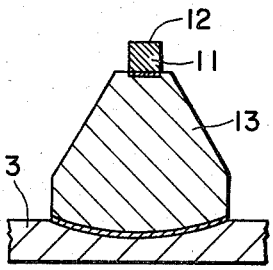

In a print hammer shown in FIG. 6, a contactor base 13 is brazed to or welded to one surface of the free end portion of a leaf spring 3. After the flat surface of the contactor base 13 is brought in contact with the flat surface of a column-shaped contactor 11, the base is brazed to or welded to the contactor.

Figure 7:
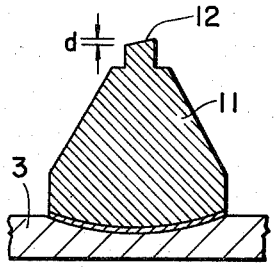

A print hammer shown in FIG. 7 is different from that shown in FIG. 4 only in that the contact end 12 of its contactor 11 has a gradient (d). As shown in the figure, the contact end has a slant with an elevational difference (d) from one edge to the other.

Figure 8:
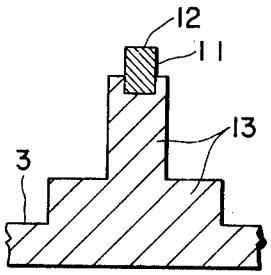

In print hammer shown in FIG. 8, a base 13 is provided by padding a leaf spring on one surface of the free end portion of a leaf spring 3. A column-shaped contactor 11 is press-fitted into the base 13 in such a manner that the flat surface of the two parts are in contact with each other.

Figure 9:
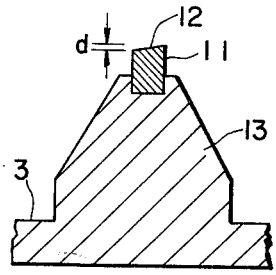

A print hammer shown in FIG. 9 is similar to that shown in FIG. 8 except that the contact end 12 of the trapezoid contactor 11 has a gradient (d) and its base 13 is trapezoidal in section.

Figure 10:
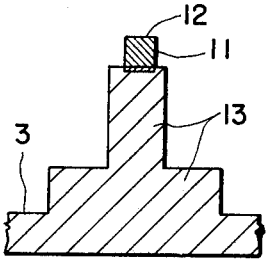

A print hammer shown in FIG. 10 is similar to that shown in FIG. 8 except that a contactor 11 is brazed to or welded to a base 13.

Figure 11:
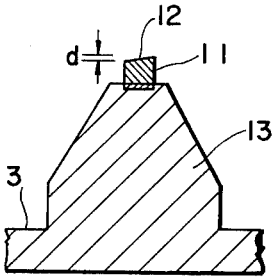

A print hammer shown in FIG. 11 is similar to that shown in FIG. 8 except that the contact end 12 of the contactor 11 has a gradient (d). Also, the contactor 11 is welded to or brazed to a base 13 which is trapezoidal in section.

Figure 12:
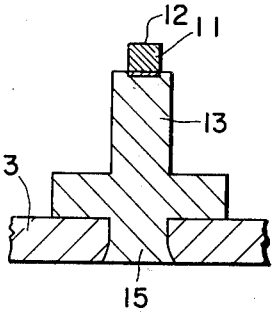

In a print hammer shown in FIG. 12, a cylindrical base 13 having a member 15 is fixedly secured by staking to one surface of one free end portion of a leaf spring 3, and the base 13 is brazed to or welded to a column-shaped contactor 11 with the flat surfaces of the two parts brought into contact with each other.

Figure 13:
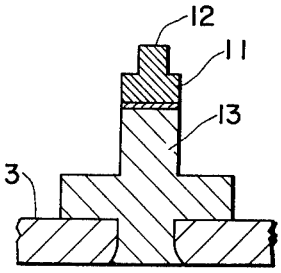

A print hammer shown in FIG. 13 is similar to that shown in FIG. 12 except that the contactor 11 thereof is in the form of a cylinder having a larger diameter portion and a smaller diameter portion.

Figure 14:
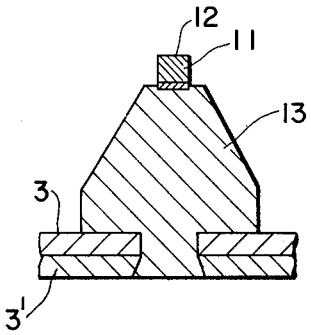

A print hammer shown in FIG. 14 is similar to that shown in FIG. 12 except that the former comprises a trapezoidal base 13 and a compound leaf springs 3 and 3' are used as shown.

Figure 15:
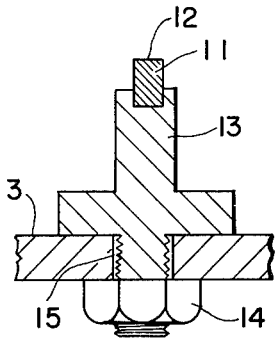

A print hammer shown in FIG. 15 is similar to that shown in FIG. 12 except that a contact 11 is press-fitted into a recess in a base 13, which is fixedly secured to a leaf spring 3 by a nut 14. Ths nut 14 is screwed on the threaded portion of the member 15 of the base 13.

Figure 16:
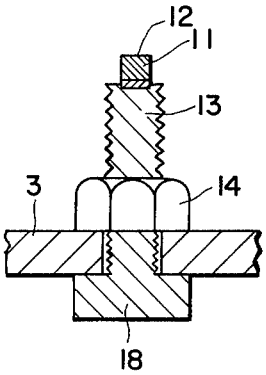

A print hammer shown in FIG. 16 is different from that shown in FIG. 12 only in that its base 13 is fixedly secured to a leaf spring 3 by a nut 14. The nut 14 is screwed on the threaded portion of the base 13. The base 13 has a head 18. Hence the attachment in this example is reversed from that shown in FIG. 15 since the nut is placed inside the leaf spring.

Figure 17:
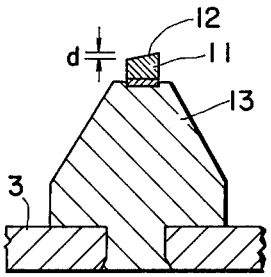

A print hammer shown in FIG. 17 is different from that shown in FIG. 12 only in that the contact end 12 of the contactor 11 has a gradient (d) and its base is trapezoidal.

Figure 18:
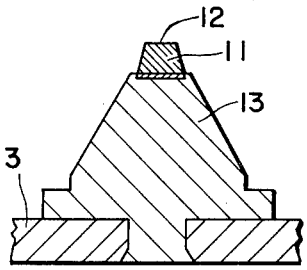

A print hammer shown in FIG. 18 is similar to that shown in FIG. 12 except that it comprises a trapezoidal base 13. with a flange, and a trapezoidal contactor 11.

Figure 19:
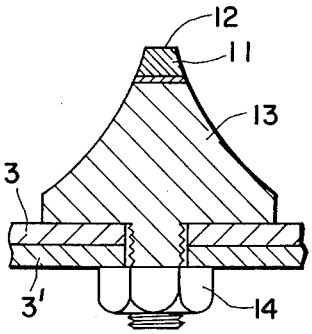

A print hammer shown in FIG. 19 is similar to that shown in FIG. 12 except that it comprises a compound leaf springs 3, 3' and a base 13 fixedly secured to the leaf spring 3 by a nut 14. Also, its configuration is substantially conical as a whole. The nut 14 is screwed on the threaded portion of the base 13.

Figure 20:
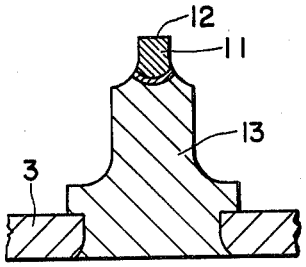

A print hammer shown in FIG. 20 is similar to that shown in FIG. 12 except that the contactor 11 having the column-shaped contact end 12 is fixedly secured to the base 13 with the curved surfaces brought into contact with each other. The base has a flange, and the base smoothly extends to the contactor 11.

Figure 21:
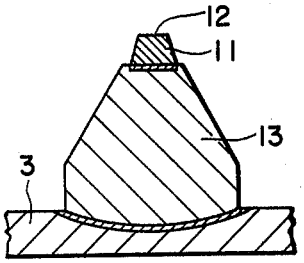

A print hammer shown in FIG. 21 is similar to that shown in FIG. 6 except that it employs a trapezoidal contactor 11.

Figure 22:
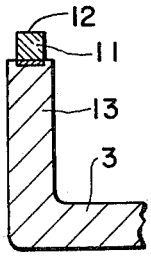

In a print hammer shown in FIG. 22, the free end portion of a leaf spring 3 is formed as a contactor base 13 to which a column-shaped contactor 11 is fixedly secured. In other words, the base 13 is obtained by bending the leaf spring 3 in such a manner that the former 13 protrude from the plane of the leaf spring. The contactor 11 is brazed to or welded to the base 13 with the flat surfaces of these two parts brought into contact with each other.

Figure 23:
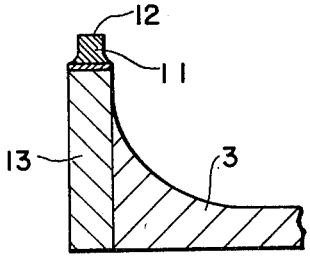
Figure 24:
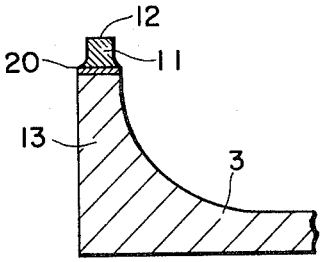

A print hammer shown in FIG. 23 is similar to that shown in FIG. 22 except that it has a tapered contactor 11 with a column-shaped contact end 12, and a base 13 in the form of a protrusion brazed to or welded to one end of a leaf spring 3. The free end portion of the leaf spring has a gradual increase in size, or web, between the base portion 13 and the spring body.

A print hammer shown in FIG. 14 is similar to that shown in FIG. 22 except that its base 13 is obtained by padding 20 the free end portion of a leaf spring 3.

Figure 25:
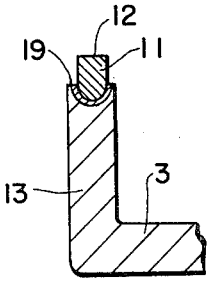

In a print hammer shown in FIG. 25, the free end portion of a leaf spring 3 is formed as a contactor base 13 to which a column-shaped contactor 11 is fixedly secured. In other words, the free end portion of the leaf spring 3 is bent to form the contactor base 13, and the contactor 11 is brazed to or welded to the base 13 with the curved surfaces of these two parts brought into contact with each other. The remaining portion of the base has a flat portion 19.

Figure 26:
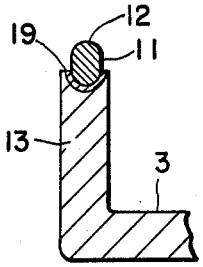

A print hammer shown in FIG. 26 is different from that shown in FIG. 25 only in that it employs a contactor 11 with a spherical contact end 12.

Figure 27:
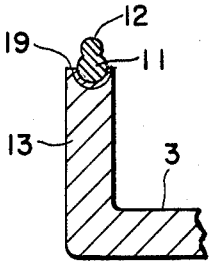

A print hammer shown in FIG. 27 is similar to that shown in FIG. 25 except that it has a spherical contactor 11 having a narrow part.

Figure 28:
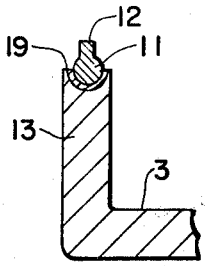

A print hammer shown in FIG. 28 is different from that shown in FIG. 26 only in that it has a spherical contactor 11 having a column-shaped contact end 12.

Figure 29:
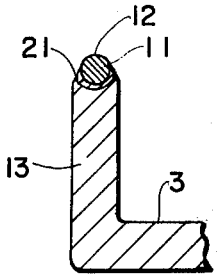

A print hammer shown in FIG. 29 is similar to that shown in FIG. 25 except that it has a spherical contactor 11, and the end portion 21 of the base 13 is tapered so that the base 13 and the contactor 11 form a smooth surface and continuous junction point.

Figure 30:
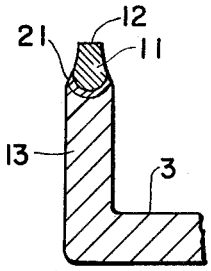

A print hammer shown in FIG. 30 is similar to that shown in FIG. 25 except that it has a conical contactor 11 with a column-shaped contact end 12, and its base 13 is tapered at portion 21 so that the base 13 and the contactor 11 form a smooth surface.

Figure 31:
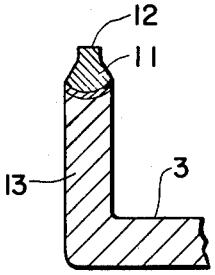

A print hammer shown in FIG. 31 is similar to that shown in FIG. 25 except that it has a conical contactor 11 with a column-shaped contact end 12. The contact end occupies substantially all of the space of the spring free end.

Figure 32:
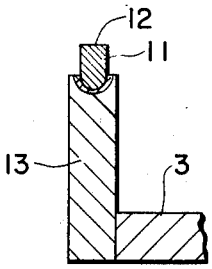

In a print hammer shown in FIG. 32, a contactor base 13 is connected to the free end of a leaf spring 3, and a column-shaped contactor 11 is fixedly secured to the base 13. More specifically, the base 13 is brazed to or welded to the free end of the leaf spring 3, and the contactor 11 is brazed to or welded to the base 13 with the curved surfaces of the two parts brought into contact with each other.

Figure 33:
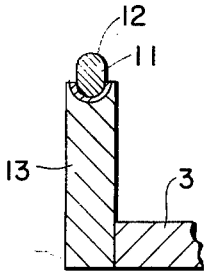

A print hammer shown in FIG. 33 is similar to that shown in FIG. 32 except that its contactor 11 has a spherical contact end 12.

Figure 34:
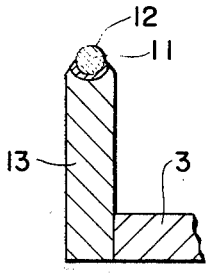

A print hammer shown in FIG. 34 is similar to that shown in FIG. 32 except that it employs a spherical contactor 11, and the base 13 is tapered so that the base and the contactor form a smooth surface.

Figure 35:
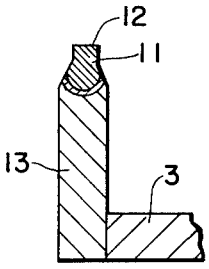

A print hammer shown in FIG. 35 is similar to that shown in FIG. 32 except that its uses a spherical contactor 11 having a column-shaped contactor end 12, and the base 13 is tapered so that the base and the contactor form a smooth surface.

Figure 36:
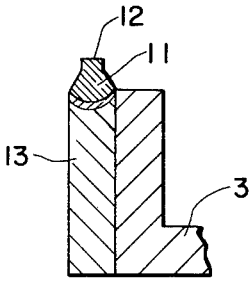

A print hammer shown in FIG. 36 is similar to that shown in FIG. 32 except that it has a conical contactor with a protruding contact end 12, the free end portion of a leaf spring 3 is bent to protrude from the plane of the leaf spring, and a base 13 is fixedly secured to the free end portion thus bent.

The advantages of the invention will be delineated in the following examples thereof:

EXAMPLE 1

A print hammer was formed according to the following method. A contactor base (SUS 303) having a flange was fixedly secured by staking to one surface of the free end portion of a leaf spring (SK-5, Vickers hardness 580). A contactor (50% Os—34% Ir—10% Ru—6% Pt, by weight) having a column-shaped contact end 0.44 mm in diameter was connected by gold brazing to the contactor base, with the curved surface of these two parts brought into contact with each other. The base was tapered so that the base and the contactor formed a smooth surface.

EXAMPLE 2

A print hammer was formed in a similar manner as the print hammer in Example 1 except that the contactor was connected to the contactor base by welding.

EXAMPLE 3

A print hammer was formed in a similar manner as the print hammer in Example 1 except that a contactor (50% Re—42% Os—8% Ta, by weight) was employed.

EXAMPLE 4

A print hammer was formed in a similar manner as the print hammer in Example 1 except that a contactor (50% Re—42% Os—8% Ta, in weight) was welded to the contactor base.

EXAMPLE 5

A print hammer was formed in a similar manner as the print hammer in Example 1 except that a contactor (69.5% Re—20% Ru—10% Ta—0.5% B, by weight) was used.

EXAMPLE 6

A print hammer was formed in a similar manner as the print hammer in Example 1 except that a contactor (69.5% Re—20% Ru—10% Ta—0.5% B, by weight) was connected to the contactor base by welding.

EXAMPLE 7

A print hammer was formed according to the following method. The free end portion of a leaf spring (SK-5, Vickers hardness 580) was bent to form a contactor base which was accordingly protruded from the plane of the original leaf spring. A conical contactor (50% Os—34% Ir—10% Ru—6% Pt, by weight) having a column-shaped contact end 0.3 mm in diameter was connected by gold brazing to the contactor base thus formed, with the curved surfaces of these two parts brought into contact with each other.

EXAMPLE 8

A print hammer was formed in a similar manner as the print hammer in Example 7 except that the contactor was welded to the contactor base.

EXAMPLE 9

A print hammer was formed in a similar manner as the print hammer in Example 7 except that a contactor (50% Re—42% Os—8% Ta, by weight) was used.

EXAMPLE 10

A print hammer was formed in a similar manner as the print hammer in Example 7 except that a contactor (50% Re—42% Os—8% Ta, by weight) was connected to the contactor base by welding.

EXAMPLE 11

A print hammer was formed in a similar manner as the print hammer in Example 7 except that a contactor (69.5% Re—20% Ru—10% Ta—0.5% B, by weight) was used.

EXAMPLE 12

A print hammer was formed in a similar manner as the print hammer in Example 7 except that a contactor (69.5% Re—20% Ru—10% a—0.5% B, by weight) was connected to the contactor base by welding.

Two print hammers as indicated in Comparison Hammers 1 and 2 were formed for comparison with the print hammers according to the invention.

COMPARISON HAMMER 1

A print hammer was fabricated by staking a contactor to one surface of the free end portion of a leaf spring (SK-5, Vickers hardness 580). The contactor had a flange, and a column-shaped contact end 0.44 in diameter. (SK-5 Vickers hardness 800).

COMPARISON HAMMER 2

A print hammer was fabricated by staking a contactor base (SUS 303) having a flange to one surface of the free end portion of a leaf spring (SK-5, Vickers hardness 580), inserting a sintered hard alloy contactor (95% WC—5% Co, by weight) 0.44 mm in diameter into the contactor base, and connecting the contactor to the base by silver blazing.

The results of comparison tests between the print hammers of the invention as in Examples 1 through 12 and the print hammers as in Comparison Hammers 1 and 2 are as indicated in the following Table. In the comparison tests, the print hammers were mounted in the dotting drive section of a dot printer, and were operated to hammer a recording sheet through a nylon ink ribbon, with a hammer driving frequency 1,000 Hz, an impact force 18 Newtons, a contactor swinging distance 0.5 mm.

TABLE

| Example | Wear of Contact End of Contactor | Welded Part | Printing Durability |
|---|---|---|---|
| 1 | 0.012 mm | Not broken, bent, or buckled | $5 \times 10^8$ dots |
| 2 | 0.020 mm | Not broken, bent, or buckled | $1 \times 10^9$ dots |
| 3 | 0.015 mm | Not broken, bent, or buckled | $5 \times 10^8$ dots |
| 4 | 0.024 mm | Not broken, bent, or buckled | $1 \times 10^9$ dots |
| 5 | 0.022 mm | Not broken, bent, or buckled | $5 \times 10^8$ dots |
| 6 | 0.036 mm | Not broken, bent, or buckled | $1 \times 10^9$ dots |
| 7 | 0.016 mm | Not broken, bent, or buckled | $5 \times 10^8$ dots |
| 8 | 0.027 mm | Not broken, bent, or buckled | $1 \times 10^9$ dots |
| 9 | 0.018 mm | Not broken, bent, or buckled | $5 \times 10^8$ dots |
| 10 | 0.032 mm | Not broken, bent, or buckled | $1 \times 10^9$ dots |
| 11 | 0.034 mm | Not broken, bent, or buckled | $5 \times 10^8$ dots |
| 12 | 0.047 mm | Not broken, bent, or buckled | $1 \times 10^9$ dots |
| Comparison 1 | 0.330 mm | — | $1 \times 10^7$ dots |
| | (The print hammer was worn too much to continue printing, and the test was suspended.) | | |
| 2 | 0.048 mm | Broken | $2.3 \times 10^7$ dots |

As is apparent from the Table, the print hammers according to the invention offer considerably improved performance, thus being significantly useful in a dot printer. Although a number of examples are shown, the invention is not limited thereto, since other modifications are possible without departing from the scope of the invention.

What is claimed is:

1. A print hammer in a dot printer comprising; a leaf spring having a free end portion, a contactor made of a wear-resistive alloy selected from the group consisting of platinum group metal alloys, alloys of platinum group metal and transition metal, and alloys of platinum group metal, transition metal and boron, a contactor base provided on the free end portion of said leaf spring and having a tapered curved end portion, said contactor and said contactor base tapered curved end portion having compatible curved surfaces, and means to secure said contactor to said contactor base with said compatible curved surfaces brought into contact with each other.

2. A print hammer in a dot printer comprising; a leaf spring having a free end portion, a contactor made of a wear-resistive alloy selected from the group consisting of platinum group metal alloys, alloys of platinum group metal and transition metal, and alloys of platinum group metal, transition metal and boron, said contactor having a contact end in the form of a column, a contactor base provided on the free end portion of said leaf spring and having a tapered curved end portion, said contactor and said contactor base having compatible curved surfaces, and means to secure said contactor to said contactor base with said compatible curved surfaces brought into contact with each other.

3. A print hammer as claimed in claim 1 or claim 2, in which said contactor is provided on one surface of said free end portion of said leaf spring.

4. A print hammer as claimed in claim 1 or claim 2, wherein said contactor is provided on said free end portion of said leaf spring wherein said contactor protrude at least from the plane of said leaf spring.

5. A print hammer as claimed in claim 1 or claim 2, wherein said contactor is secured to said leaf spring by brazing.

6. A print hammer as claimed in claim 1 or claim 2, wherein said contactor is secured to said leaf spring by welding.

7. A print hammer as claimed in claim 1 or claim 2, wherein said contactor has a contact end which is spherical.

8. A print hammer as claimed in claim 1 or claim 2, wherein said contactor base is obtained by bending said free end portion of said leaf spring in such a manner that said free end portion protrudes from the plane of said leaf spring.

9. A print hammer as claimed in claim 1 or claim 2, wherein said contactor base is the free end portion of said leaf spring, said free end portion being bent to form a bent portion which protrudes from the plane of said leaf spring.

10. A print hammer as claimed in claim 1 or claim 2, wherein said contactor base is a protrusion joined to one surface of said leaf spring.

11. A print hammer as claimed in claim 1 or claim 2, wherein said contactor is secured to said contactor base by brazing or welding.

12. A print hammer in a dot printer comprising; a leaf spring having a free end portion, a contactor made of a wear-resistive alloy selected from the group consisting of platinum group metal alloys, alloys of platinum group metal and transition metal, and alloys of platinum group metal, transition metal and boron, said contactor formed as a tapered column having a contact end, a contactor base provided on the free end portion of said leaf spring, said contactor base having a curved end portion, said contactor having a curved surface compatible with said contactor base curved end portion and disposed opposite to said contact end, and means to secure said contactor to said contactor base with said compatible curved surface and said curved end portion brought into contact with each other.

* * * * *